US007362079B1

(12) United States Patent
Maheedhar et al.

(10) Patent No.: US 7,362,079 B1
(45) Date of Patent: Apr. 22, 2008

(54) VOLTAGE REGULATOR CIRCUIT

(75) Inventors: Suryadevara Maheedhar, Bangalore (IN); Badrinarayanan Kothandaraman, Bangalore (IN)

(73) Assignee: Cypress Semiconductor Corporation, San Jose, CA (US)

( * ) Notice: Subject to any disclaimer, the term of this patent is extended or adjusted under 35 U.S.C. 154(b) by 426 days.

(21) Appl. No.: 11/068,419

(22) Filed: Feb. 28, 2005

Related U.S. Application Data

(60) Provisional application No. 60/549,698, filed on Mar. 3, 2004.

(51) Int. Cl.
*G05F 1/40* (2006.01)

(52) U.S. Cl. ..... 323/269; 307/541

(58) Field of Classification Search ..... 323/269, 323/273, 274, 275, 276, 277, 280, 314; 327/540, 327/541, 539, 544
See application file for complete search history.

(56) References Cited

U.S. PATENT DOCUMENTS 5,892,381 A * 4/1999 Koifman et al. ..... 327/541
6,414,537 B1 * 7/2002 Smith ..... 327/540
6,985,027 B2 * 1/2006 Yabe ..... 327/541

* cited by examiner

*Primary Examiner*—Jessica Han
(74) *Attorney, Agent, or Firm*—Dale B. Halling

(57) ABSTRACT

A voltage regulator circuit has a standby amplifier with an output coupled to a gate of an output transistor. An active amplifier has an output coupled to the gate of the output transistor and to a gate of a replica follower transistor. A voltage regulated output is coupled to a source of the output transistor.

19 Claims, 1 Drawing Sheet

VOLTAGE REGULATOR CIRCUIT

RELATED APPLICATIONS

The present invention claims priority on provisional patent application Ser. No. 60/549,698, filed on Mar. 3, 2004, entitled "Voltage Regulator Architecture and Method of Operating the Same".

FIELD OF THE INVENTION

The present invention relates generally to the field of electronic circuits and more particularly to a voltage regulator circuit.

BACKGROUND OF THE INVENTION

A voltage regulator circuit is used to convert one supply voltage into another supply voltage. For instance, an integrated circuit may have an internal power supply voltage of 3.3 volts but may have an external power supply voltage of 5.0 volts. As a result, this integrated circuit needs a circuit that converts the external power supply voltage of 5.0 volts to an internal power supply voltage of 3.3 volts. One solution has been to use a pair of closed loop amplifiers. One low current amplifier works in standby mode and a high current amplifier in active mode. They control an output transistor in series with a voltage divider circuit. The feedback loop compares a node of the voltage divider circuit with a reference voltage. One problem with this solution is that it does not respond quickly to load current transients. These load current transients can occur when suddenly large amount of activity starts for example during an address switching or when chip goes from standby to active mode.

Another solution that has been used is a closed loop amplifier system in standby mode and non-linear amplifier system in active mode for fast response. This solution increases the response time of the voltage regulator but introduces switching noise and jitter.

Thus there exists a need for voltage regulator that has a fast response time and has improved stability.

SUMMARY OF INVENTION

A voltage regulator circuit that overcomes these and other problems has a standby amplifier with an output coupled to a gate of an output transistor. An active amplifier has an output coupled to the gate of the output transistor and to a gate of a replica follower transistor. A voltage regulated output is coupled to a source of the output transistor. A chip enable signal may be coupled to the gate of the output amplifier. A capacitor may be coupled between the chip enable signal and the gate of the output transistor. The replica follower transistor may be significantly smaller than the output transistor. The active amplifier may be an open control amplifier. A positive input of the active amplifier may be coupled to a reference voltage and a negative input may be coupled to a replica follower circuit. A positive input of the standby amplifier may be coupled to the reference voltage and a negative input may be coupled to a output circuit.

In one embodiment, a voltage regulator circuit has a closed loop amplifier with an output coupled to a gate of an output transistor. An open control amplifier has an output coupled to the gate of the output transistor and a gate of a replica follower transistor. A voltage regulated output is coupled to a source of the output transistor. An external voltage may be coupled to a drain of the output transistor and a pair of resistors may be coupled in series between the source of the output transistor and a ground. A chip enable signal may be coupled to the gate of the output transistor. A capacitor may be coupled between the chip enable signal and the gate of the output transistor. An external voltage may be coupled to a drain of the replica follower transistor and a pair of resistors may be coupled in series between the source of the replica follower transistor and a ground. A negative input of the open control amplifier may be coupled to a node between the pair of resistors. A positive input of the open control amplifier may be coupled to a reference voltage.

In one embodiment, a voltage regulator circuit has an amplifier with an output coupled to a gate of an output transistor. A chip enable signal is coupled to the gate of the output transistor. A voltage regulated output is coupled to a source of the output transistor. In one embodiment, the amplifier includes a standby amplifier and an active amplifier. An output of the active amplifier is coupled to the gate of a replica follower transistor and the gate of the output transistor. The output transistor may be larger than the replica follower transistor. A capacitor may be coupled between the chip enable signal and the gate of the output transistor. A reference voltage may be coupled to an input of the amplifier. A second input of the amplifier may be coupled to a node between a pair of resistors which are coupled between a source of the output transistor and a ground.

DETAILED DESCRIPTION OF THE DRAWINGS

Figure 1:
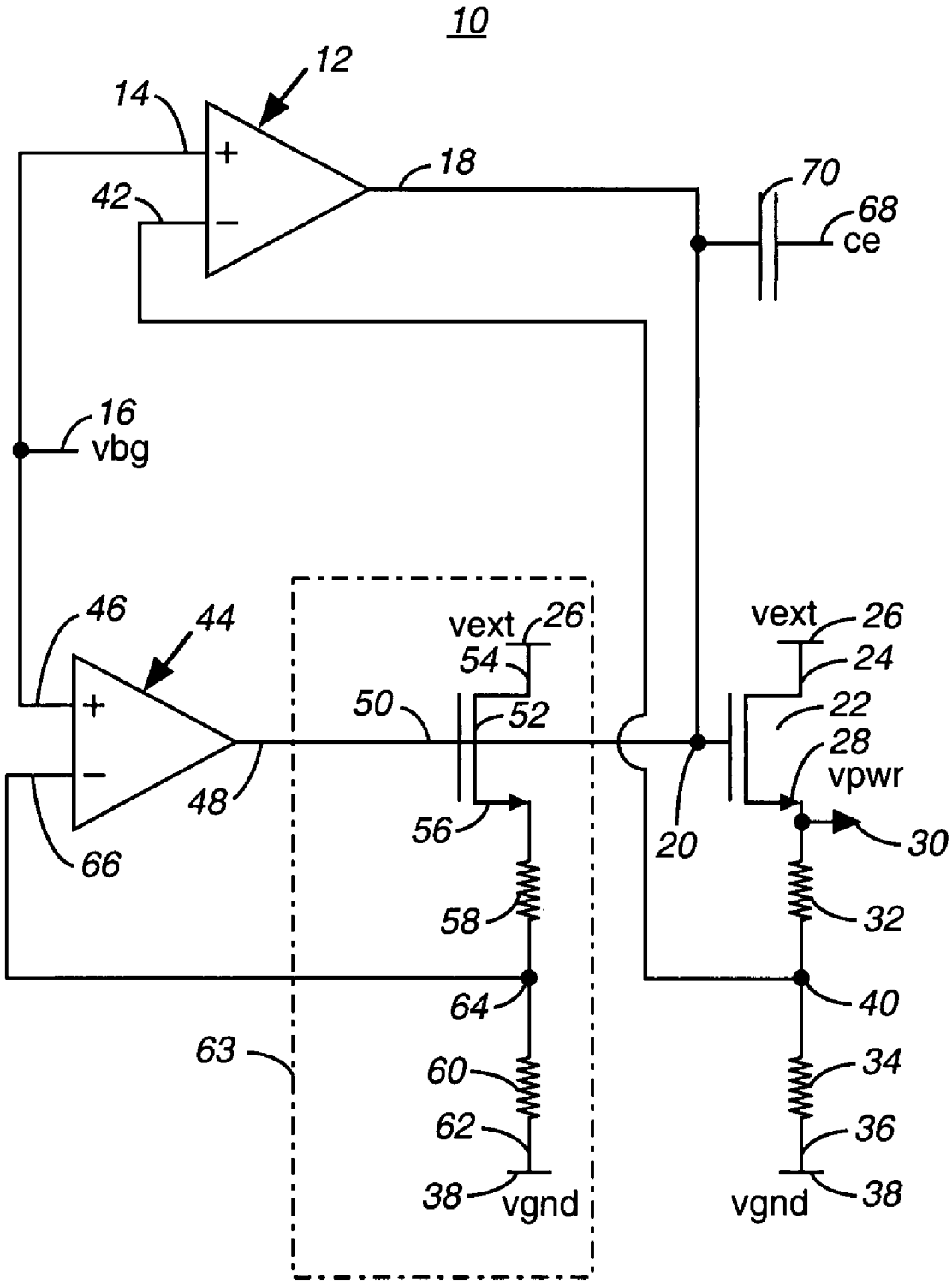
FIG. 1 is a schematic diagram of a voltage regulator circuit in accordance with one embodiment of the invention.

The voltage regulator circuit described herein has excellent stability and a fast response time. The voltage regulator circuit includes a closed loop standby amplifier circuit and an open control active amplifier circuit both having outputs coupled to a gate of the output transistor. The output of the active amplifier is also coupled to a replica stage that is a replica of the output stage, except that the replica follower transistor is smaller than the output transistor. This allows the active amplifier stage to provide the necessary current when an integrated circuit switches between no current situation to full current situation and still have excellent stability. The voltage regulator circuit of the present invention is particularly useful for micro-power applications, such as static random access memory (SRAM) applications and also for mobile SRAM applications. The open control amplifier circuit is an amplifier circuit that drives the output transistor in an open-loop nature, but has a closed loop feedback path through a replica stage.

FIG. 1 is a schematic diagram of a voltage regulator circuit 10 in accordance with one embodiment of the invention. The circuit 10 has a standby amplifier 12 having a non-inverting input 14 coupled to a reference voltage source (Vbg) 16. Commonly, the reference voltage is based on a band gap voltage of a transistor. The output 18 is coupled to a gate 20 of the output transistor 22. The output transistor 22 is an n-channel Field Effect Transistor (FET). The drain 24 of the output transistor 22 is coupled to an external power supply voltage (Vext) 26. The source 28 of the output transistor 22 is coupled to an internal voltage supply (Vpwr) 30. The internal voltage supply 20 is the voltage regulated output of the circuit 10. The source 28 is also coupled to a pair of resistors 32 & 34. One end 36 of the second resistor 34 is coupled to electrical ground 38. The output transistor 22 and pair of resistors 32 & 34 form the output stage. A node 40 between the pair of resistors 32 & 34 is coupled to an inverting input 42 of the standby amplifier 12.

An active amplifier 44 has a non-inverting input 46 coupled to the reference voltage (Vbg) 16. An output 48 of the active amplifier 44 is coupled to a gate 50 of a replica follower transistor 52. The replica follower transistor 52 is an n-channel Field Effect Transistor (FET) and is a smaller version of the output transistor 22. In one embodiment, the replica follower transistor 52 is one hundredth the size of the output transistor's 22 physical size. The output 48 of the active amplifier 44 is also coupled to the gate 20 of the output transistor 22. A drain 54 of the replica follower transistor 52 is coupled to an external voltage supply 26. A source 56 of the replica follower transistor 52 is coupled to a pair of resistors 58 & 60. A second end 62 of the second resistor 60 is coupled to electrical ground 38. The pair of resistors 58 & 60 is replicas of the resistors 32 & 36. If the physical size of replica follower transistor 52 is one-hundredth of the physical size of final transistor 22, then the total resistance value of 58 and 60 should be such that the current through the resistors is also one-hundredth of the maximum load current. This is the principle of replica. The maximum load current is replicated in the replica stage. The replica follower transistor 52 and pair of resistors 58 & 60 form the replica follower stage 63. A node 64 between the pair of transistors 58 & 60 is coupled to an inverting input 66 of the active amplifier 44. The active amplifier 44 is part of an open control amplifier system.

A chip enable (ce) signal 68 is coupled through a capacitor 70 to the gate 20 of the output transistor 22. The chip enable signal 68 is high when the integrated circuit is in active mode and is low when the integrated circuit is in the standby mode.

When the integrated circuit using this voltage regulator circuit 10 is in standby mode the integrated circuit is disabled and the amount of the load current is reduced and fixed. In one embodiment, the required current in the standby mode is on the order of micro-amperes. When the integrated circuit is in active mode, the integrated circuit is enabled and the load current is high and variable. In one embodiment, the required current in the active mode is on the order of milli-amperes. Note that it is common in some integrated circuits to switch between the active and standby modes on average every 55 nanoseconds.

When the integrated circuit is in standby mode, the regulated voltage output 30 draws very little current. The active amplifier 44 is off in the standby mode and the standby amplifier 12 determines the voltage of the gate 20 of the output transistor 22. In the active mode, the active amplifier 44 is on and drives a higher voltage on the gate 20 of the voltage follower transistor 22. As a result, the standby amplifier 12 looses its gain. The active amplifier 44 is controlled by the chip enable signal.

The large size of the output transistor 22 in a voltage follower configuration allows the circuit 10 to supply large transient currents to the integrated circuit. The small replica follower transistor 50 and active amplifier 44 allows the circuit 10 to have a fast response. The capacitor 70 and chip enable (ce) signal 68 also help to provide better response time than previous voltage regulator circuits, by providing additional current during the transition between standby and active mode. The standby amplifier 12 provides a stable voltage with a small current drain when the integrated circuit is in standby mode.

Thus there has been described a voltage regulator circuit that has a fast response time and has improved stability over previous designs.

While the invention has been described in conjunction with specific embodiments thereof, it is evident that many alterations, modifications, and variations will be apparent to those skilled in the art in light of the foregoing description. Accordingly, it is intended to embrace all such alterations, modifications, and variations in the appended claims.

What is claimed is:

1. A voltage regulator circuit, comprising:

a standby amplifier having an output coupled to a gate of an output transistor;

an active amplifier having an output coupled to the gate of the output transistor and to a gate of a replica follower transistor; and a voltage regulated output coupled to a source of the output transistor.

2. The circuit of claim 1, further including a chip enable signal coupled to the gate of the output amplifier.

3. The circuit of claim 2, further including a capacitor between the chip enable signal and the gate of the output transistor.

4. The circuit of claim 1, wherein the replica follower transistor is significantly smaller than the output transistor.

5. The circuit of claim 1, wherein the active amplifier is an open loop control amplifier.

6. The circuit of claim 5, wherein a positive input of the active amplifier is coupled to a reference voltage and a negative input is coupled to a replica follower circuit.

7. The circuit of claim 6, wherein a positive input of the standby amplifier is coupled to the reference voltage and a negative input coupled to a output circuit.

8. A voltage regulator circuit, comprising:

a closed loop amplifier having an output coupled to a gate of an output transistor;

an open control amplifier having an output coupled to the gate of the output transistor and a gate of a replica follower transistor; and a voltage regulated output coupled to a source of the output transistor.

9. The circuit of claim 8, wherein an external voltage is coupled to a drain of the output transistor and a pair of resistors is coupled in series between the source of the output transistor and a ground.

10. The circuit of claim 9, further including a chip enable signal coupled to the gate of the output transistor.

11. The circuit of claim 10, further including a capacitor coupled between the chip enable signal and the gate of the output transistor.

12. The circuit of claim 8, wherein an external voltage is coupled to a drain of the replica follower transistor and a pair of resistors is coupled in series between the source of the replica follower transistor and a ground.

13. The circuit of claim 12, wherein a negative input of the open control amplifier is coupled to a node between the pair of resistors.

14. The circuit of claim 13, wherein a positive input of the open control amplifier is coupled to a reference voltage.

15. A voltage regulator circuit comprising:

an amplifier having an output coupled to a gate of an output transistor;

a chip enable signal directly electrically connected to a capacitor, the capacitor directly electrically connected to the gate of the output transistor; and a voltage regulated output coupled to a source of the output transistor.

16. The circuit of claim 15, wherein the amplifier includes a standby amplifier and an active amplifier, wherein an output of the active amplifier is coupled to the gate of a replica follower transistor and the gate of the output transistor.

17. The circuit of claim 16, wherein the output transistor is larger than the replica follower transistor.

18. The circuit of claim 15, further including a reference voltage coupled to an input of the amplifier.

19. The circuit of claim 18, wherein a second input of the amplifier is coupled to a node between a pair of resistors coupled between a source of the output transistor and a ground.

* * * * *